US011332911B2

(12) United States Patent
Takebayashi et al.

(10) Patent No.: US 11,332,911 B2
(45) Date of Patent: May 17, 2022

(54) CONSTRUCTION MACHINE

(71) Applicant: Hitachi Construction Machinery Tierra Co., Ltd., Koka (JP)

(72) Inventors: Yoshifumi Takebayashi, Koka (JP); Hajime Yoshida, Omihachiman (JP); Natsuki Nakamura, Koka (JP); Daisuke Oka, Yasu (JP)

(73) Assignee: Hitachi Construction Machinery Tierra Co., Ltd., Koka (JP)

( * ) Notice: Subject to any disclaimer, the term of this patent is extended or adjusted under 35 U.S.C. 154(b) by 555 days.

(21) Appl. No.: 16/328,345

(22) PCT Filed: Sep. 29, 2017

(86) PCT No.: PCT/JP2017/035675
§ 371 (c)(1),
(2) Date: Feb. 26, 2019

(87) PCT Pub. No.: WO2019/064557
PCT Pub. Date: Apr. 4, 2019

(65) Prior Publication Data

US 2021/0332560 A1 Oct. 28, 2021

(51) Int. Cl.

| | |
|---|---|
| ***E02F 9/22*** | (2006.01) |
| ***E02F 3/96*** | (2006.01) |
| ***E02F 9/20*** | (2006.01) |
| ***F15B 15/20*** | (2006.01) |

(52) U.S. Cl.
CPC ..... *E02F 9/2228* (2013.01); *E02F 3/964* (2013.01); *E02F 9/2004* (2013.01);
(Continued)

(58) Field of Classification Search
CPC ..... E02F 9/2203; E02F 3/844; E02F 9/2285; E02F 3/964; E02F 9/2228;
(Continued)

(56) References Cited

U.S. PATENT DOCUMENTS 4,166,506 A * 9/1979 Tezuka ..... E02F 3/844 172/4.5
5,426,874 A * 6/1995 Nakata ..... E02F 3/844 37/348

(Continued)

FOREIGN PATENT DOCUMENTS

JP 2002-88796 A 3/2002
JP 2009-68173 A 4/2009

OTHER PUBLICATIONS

International Search Report (PCT/ISA/210) issued in PCT Application No. PCT/JP2017/035675 dated Dec. 26, 2017 (two (2) pages).

(Continued)

*Primary Examiner* — Abiy Teka
(74) *Attorney, Agent, or Firm* — Crowell & Moring LLP

(57) ABSTRACT

Provided is a construction machine that can prevent a machine body from being lowered since a blade is not put into a float state even where a misoperation is made by an operator when the machine body is in a jacked-up state, and that can perform a favorable leveling operation by putting the blade into the float state in accordance with an operator's operation when the machine body is not in the jacked-up state. A hydraulic excavator includes a controller 42 that determines whether or not the machine body is in a jacked-up state and controls a float valve 41. In the case where it is determined that the machine body is not in the jacked-up state, the controller 42 changes over the float valve 41 to a float position V and invalidates an operation of a blade control valve 22, in accordance with a float instruction. In the case where it is determined that the machine body is in the jacked-up state, the controller 42 holds the float valve 41 in a reference position IV and validates the operation of the
(Continued)

blade control valve 22, irrespectively of the presence or absence of the float instruction.

4 Claims, 6 Drawing Sheets

(52) U.S. Cl.
CPC ..... *E02F 9/2203* (2013.01); *E02F 9/2267* (2013.01); *E02F 9/2285* (2013.01); *F15B 15/202* (2013.01); *E02F 9/2292* (2013.01)

(58) Field of Classification Search
CPC ..... F15B 2211/3127; F15B 2211/3058; F15B 2211/7741
See application file for complete search history.

(56) References Cited

U.S. PATENT DOCUMENTS 10,094,092 B2 * 10/2018 Joung ..... E02F 9/2207
2008/0121101 A1 * 5/2008 Park ..... F15B 13/01 91/446

OTHER PUBLICATIONS

Japanese-language Written Opinion (PCT/ISA/237) issued in PCT Application No. PCT/JP2017/035675 dated Dec. 26, 2017 (three (3) pages).

Notification Concerning Documents Transmitted (PCT/IB/310) issued in PCT Application No. PCT/JP2017/035675 dated May 14, 2019, including English translation of document C2 (Japanese-language Written Opinion (PCT/ISA/237) previously filed on Feb. 26, 2019) (six (6) pages).

International Preliminary Report on Patentability (PCT/IB/338 & PCT/IB/373) issued in PCT Application No. PCT/JP2017/035675 dated Apr. 9, 2020, including English translation of document C2 (Japanese-language Written Opinion (PCT/ISA/237) previously filed on Feb. 26, 2019) (six (6)pages).

* cited by examiner

CONSTRUCTION MACHINE

TECHNICAL FIELD

The present invention relates to a construction machine such as a hydraulic excavator, particularly to a construction machine capable of putting a blade into a float state.

BACKGROUND ART

Patent Document 1 discloses a construction machine including: a blade provided to be drivable in a vertical direction relative to a machine body; a blade cylinder that is operated by a hydraulic fluid delivered from a hydraulic pump and that drives the blade in the vertical direction; a blade control valve that controls a flow of the hydraulic fluid from the hydraulic pump to the blade cylinder; and a blade operation device that operates the blade control valve. This construction machine is configured such that the blade can be put into a float state (in other words, a state in which the blade is not fixed). Details of this will be described below.

In a first related art illustrated in FIG. 5 of Patent Document 1, the blade control valve has a float position (change-over position) for putting the blade into the float state, in addition to a neutral position for stopping the blade, a raising position (change-over position) for driving the blade in a raising direction, and a lowering position (change-over position) for driving the blade in a lowering direction.

In the neutral position of the blade control valve, communication of a rod-side hydraulic chamber of the blade cylinder with the hydraulic pump and a tank is interrupted, and communication of a bottom-side hydraulic chamber of the blade cylinder with the hydraulic pump and the tank is interrupted. In the raising position of the blade control valve, the rod-side hydraulic chamber of the blade cylinder is made to communicate with the hydraulic pump, and the bottom-side hydraulic chamber of the blade cylinder is made to communicate with the tank. By this, the hydraulic fluid from the hydraulic pump is supplied into the rod-side hydraulic chamber of the blade cylinder, to contract the blade cylinder, thereby raising the blade. In the lowering position of the blade control valve, the bottom-side hydraulic chamber of the blade cylinder is made to communicate with the hydraulic pump, and the rod-side hydraulic chamber of the blade cylinder is made to communicate with the tank. By this, the hydraulic fluid from the hydraulic pump is supplied into the bottom-side hydraulic chamber of the blade cylinder, to extend the blade cylinder, thereby lowering the blade.

In the float position of the blade control valve, the rod-side hydraulic chamber and the bottom-side hydraulic chamber of the blade cylinder are made to communicate with the tank. By this, the blade is put into a float state. In this instance, the blade is lowered by its own weight, to make contact with the ground. When the construction machine is made to travel forward or backward, the blade being in the float state ensures that even when the ground is rugged, the blade can follow up to the rugged shape. Therefore, a leveling work can be performed with the blade being constantly in contact with the ground.

In a second related art depicted in FIG. 4 of Patent Document 1, in place of the float position of the blade control valve as aforementioned, a branch hydraulic line branched from a supply/discharge hydraulic line connected between the blade control valve and the rod-side hydraulic chamber of the blade cylinder, and a selector valve disposed between the branch hydraulic line and a tank-side hydraulic line, are provided. The selector valve has an interruption position for interrupting the communication between the branch hydraulic line and the tank-side hydraulic line, and a communication position for establishing the communication between the branch hydraulic line and the tank-side hydraulic line. With the selector valve changed over to the communication position while keeping the blade control valve in the neutral position, the rod-side hydraulic chamber of the blade cylinder is made to communicate with the tank, and communication of the bottom-side hydraulic chamber of the blade cylinder with the hydraulic pump and the tank is interrupted.

PRIOR ART DOCUMENT

Patent Document

Patent Document 1: JP-2002-088796-A

SUMMARY OF THE INVENTION

Problem to be Solved by the Invention

The blade of a construction machine is used not only in the case of performing a leveling work but also in the case of jacking up the machine body for performing, for example, maintenance or cleaning of an undercarriage of the machine body. In the first related art aforementioned, in the case where the blade control valve is in the float position, the rod-side hydraulic chamber and the bottom-side hydraulic chamber of the blade cylinder are made to communicate with the tank. Therefore, in the case where an operator changes over the blade control valve to the float position by mistake in the jacked-up state of the machine body, the blade would be put into the float state, leading to a lowering of the machine body.

On the other hand, in the second related art aforementioned, in the case where the blade control valve is in the neutral position and the selector valve is in the communication position, only the rod-side hydraulic chamber of the blade cylinder is made to communicate with the tank. Specifically, unlike in the first related art, the bottom-side hydraulic chamber of the blade cylinder is not made to communicate with the tank. For this reason, even if the operator changes over the selector valve to the communication position by mistake in the jacked-up state of the machine body, the blade is not operated in a raising direction, so that the machine body can be prevented from being lowered.

In the second related art, however, when the operator changes over the selector valve to the communication position with the intension of performing a leveling work, the blade is not lowered or is difficultly lowered by its own weight, since the bottom-side hydraulic chamber of the blade cylinder is not made to communicate with the tank, and, accordingly, the blade does not follow up to the ruggedness of the ground. In other words, a favorable leveling work cannot be accomplished.

It is an object of the present invention to provide a construction machine which is able to prevent a machine body from being lowered, since a blade is not put into a float state, even in the case of a misoperation made by an operator, if the machine body is in a jacked-up state, and which puts the blade into the float state and is able to perform a favorable leveling work, in accordance with the operator's operation, if the machine body is not in the jacked-up state.

Means for Solving the Problem

In order to achieve the above object, according to the present invention, there is provided a construction machine including: a blade provided to be drivable in a vertical direction relative to a machine body; a blade cylinder that is operated by a hydraulic fluid delivered from a hydraulic pump and that drives the blade in the vertical direction; a blade control valve that controls a flow of the hydraulic fluid from the hydraulic pump to the blade cylinder; a blade operation device that operates the blade control valve; a float instruction device that performs a float instruction for putting the blade into a float state; a float valve that is provided in hydraulic lines communicating respectively with a bottom-side hydraulic chamber and a rod-side hydraulic chamber of the blade cylinder, and that has a reference position where driving of the blade cylinder is possible and a float position where the bottom-side hydraulic chamber and the rod-side hydraulic chamber of the blade cylinder communicate with a tank to put the blade into the float state; a pressure sensor that detects a pressure in at least one of the bottom-side hydraulic chamber and the rod-side hydraulic chamber of the blade cylinder; and a controller configured to determine whether or not the blade is in a state of jacking up the machine body and control the float valve, based on results of detection by the pressure sensor, in which the controller is configured to: change over the float valve to the float position and invalidate an operation of the blade control valve by the blade operation device, in accordance with the float instruction, in a case where it is determined that the blade is not in the state of jacking up the machine body; and hold the float valve in the reference position and validate the operation of the blade control valve by the blade operation device, irrespectively of the presence or absence of the float instruction, in a case where it is determined that the blade is in the state of jacking up the machine body.

Advantage of the Invention

According to the present invention, when the machine body is in a jacked-up state, the blade is not put into the float state, and the machine body can be prevented from being lowered, even in the case where a misoperation is made by the operator. On the other hand, when the machine body is not in the jacked-up state, the blade can be put into the float state, and a favorable leveling work can be performed, in accordance with the operator's operation.

MODES FOR CARRYING OUT THE INVENTION

One embodiment of the present invention will be described, taking a hydraulic excavator as an example of the object to which the present invention is applied.

Figure 1:
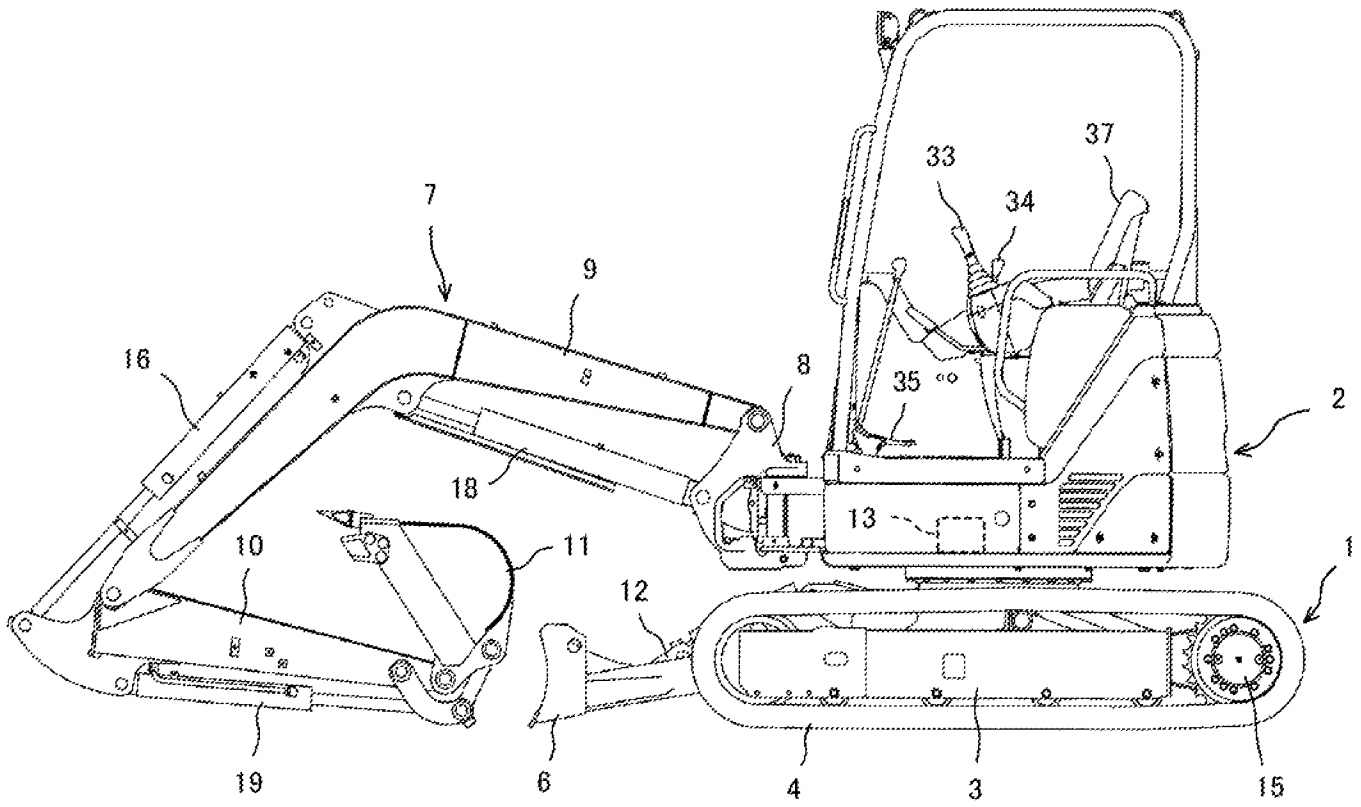
FIG. 1 is a side view representing the structure of a hydraulic excavator in one embodiment of the present invention.

FIG. 1 is a side view representing the structure of a hydraulic excavator in the present embodiment.

The hydraulic excavator in the present embodiment includes a lower track structure 1 capable of self-traveling, and an upper swing structure 2 provided on the upper side of the lower track structure 1 in a swingable manner, the lower track structure 1 and the upper swing structure 2 constituting a machine body. The upper swing structure 2 is swung by a swing motor 13.

The lower track structure 1 includes a track frame 3 which is H-shaped as viewed from above. The track frame 3 includes a center frame extending in the left-right direction (the direction perpendicular to the paper surface of FIG. 1), a left side frame provided on the left side (the viewer's side of the paper surface of FIG. 1) of the center frame and extending in the front-rear direction (the left-right direction in FIG. 1), and a right side frame provided on the right side (the depth side of the paper surface of FIG. 1) of the center frame and extending in the front-rear direction.

Figure 5:
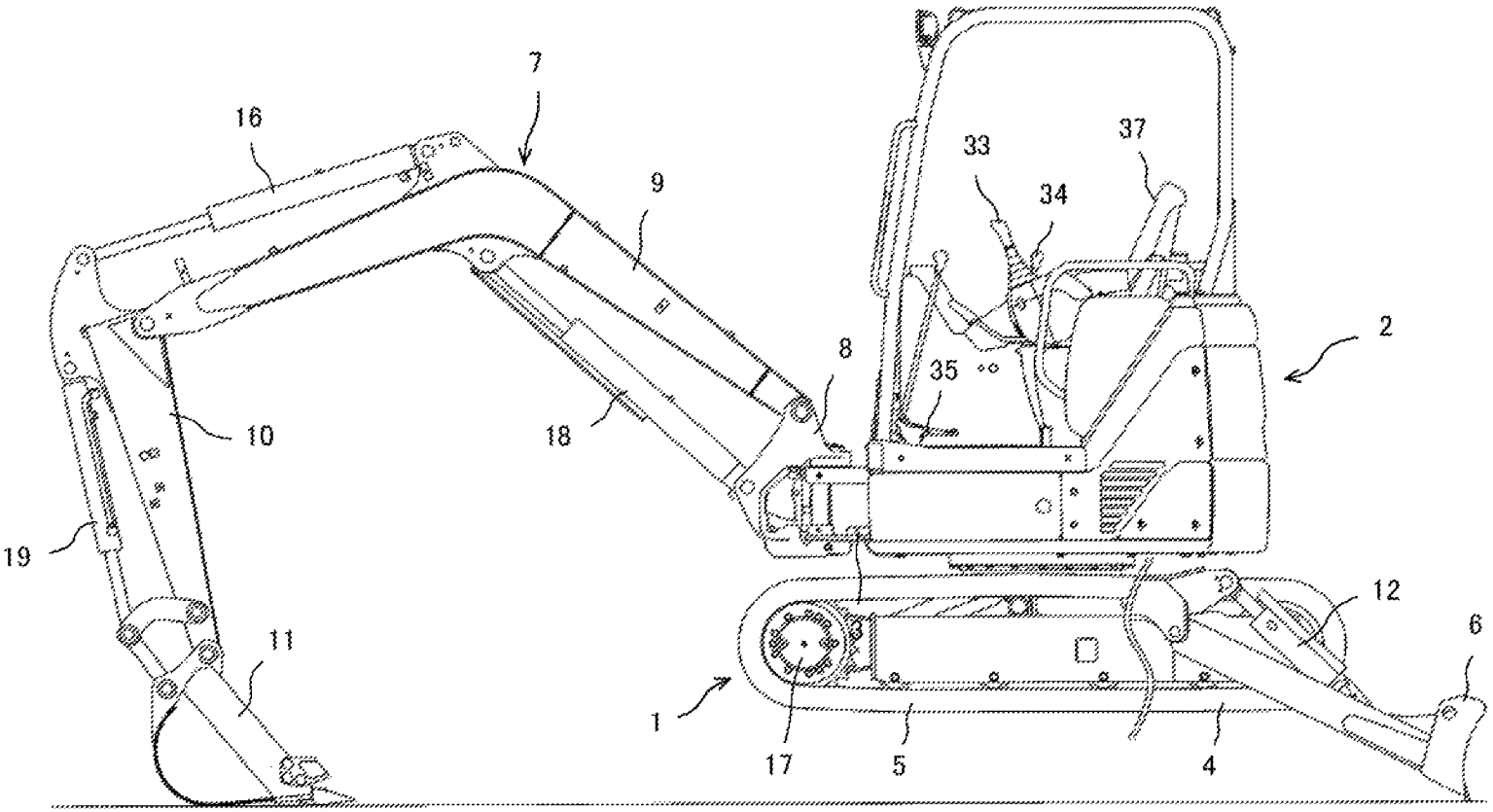
FIG. 5 is a side view depicting a state in which a machine body of the hydraulic excavator in one embodiment of the present invention is jacked up.

A left crawler type track device 4 is provided on the left side frame, and is driven by a left track motor 15. A right crawler type track device 5 (see FIG. 5 described later) is provided on the right side frame, and is driven by a right track motor 17 (see FIG. 5 described later). The lower track structure 1 travels by driving of the left and right track devices 4 and 5. A blade 6 is provided to be drivable in the vertical direction (the vertical direction in FIG. 1) relative to the center frame, and is driven in the vertical direction by a blade cylinder 12.

A work device 7 is coupled to the front side (the left side in FIG. 1) of the upper swing structure 2. The work device 7 includes a swing post 8 coupled to the upper swing structure 2 such as to be rotatable in the left-right direction, a boom 9 coupled to the swing post 8 such as to be rotatable in the vertical direction, an arm 10 coupled to the boom 9 such as to be rotatable in the vertical direction, and a bucket 11 coupled to the arm 10 such as to be rotatable in the vertical direction. The swing post 8 is rotated in the left-right direction by a swing cylinder 14 (see FIG. 2 described later), and swings the boom 9 in the left-right direction. The boom 9, the arm 10, and the bucket 11 are rotated in the vertical direction by a boom cylinder 18, an arm cylinder 16, and a bucket cylinder 19, respectively.

Figure 2:
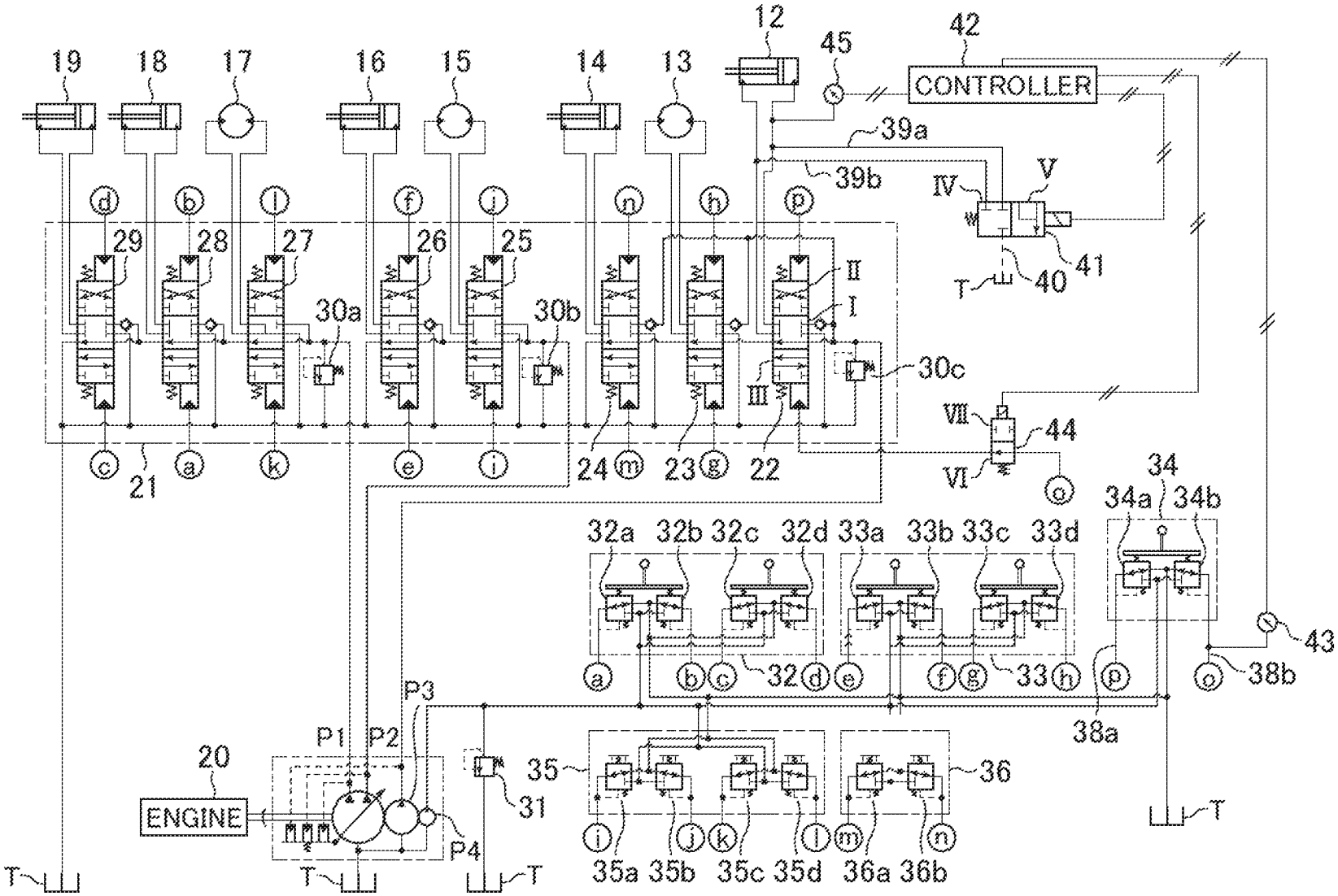
FIG. 2 is a hydraulic circuit diagram representing the configuration of a driving device of the hydraulic excavator in one embodiment of the present invention.

The upper swing structure 2, the track devices 4 and 5, the blade 6, the swing post 8, the boom 9, the arm 10, and the bucket 11 described above constitute driven bodies which are driven by a driving device mounted on the hydraulic excavator. FIG. 2 is a diagram representing the configuration of the driving device of the hydraulic excavator in the present embodiment.

The driving device in the present embodiment includes hydraulic pumps P1, P2 and P3 which are main pumps driven by an engine 20 (prime mover), a plurality of actuators (specifically, the right track motor 17, the boom cylinder 18, and the bucket cylinder 19 described above) operated by a hydraulic fluid delivered from the hydraulic pump P1, a plurality of actuators (specifically, the left track motor 15 and the arm cylinder 16 described above) driven by a hydraulic fluid delivered from the hydraulic pump P2, a plurality of actuators (specifically, the blade cylinder 12, the swing motor 13, and the swing cylinder 14 described above) driven by a hydraulic fluid delivered from the hydraulic pump P3, and a valve unit 21. Note that the hydraulic pumps P1 and P2 include split flow type hydraulic pumps.

The valve unit 21 includes: open center type control valves 27, 28 and 29 that control flows of the hydraulic fluid from the hydraulic pump P1 to the actuators 17, 18 and 19, respectively; open center type control valves 25 and 26 that control flows of the hydraulic fluid from the hydraulic pump P2 to the actuators 15 and 16, respectively; open center type control valves 22, 23 and 24 that control flows of the hydraulic fluid from the hydraulic pump P3 to the actuators 12, 13 and 14, respectively; and main relief valves 30*a*, 30*b* and 30*c* that limit delivery pressures of the hydraulic pumps P1, P2 and P3, respectively.

In addition, the driving device in the present embodiment includes a pilot pump P4 driven by the engine 20, a pilot relief valve 31 that keeps constant the delivery pressure of the pilot pump P4, and operation devices 32 to 36 that operate the control valves 22 to 29. Note that the operation device 33 is disposed on the left side of a cab seat (see FIG. 1) in a cab of the upper swing structure 2, whereas the operation devices 32 and 34 are disposed on the right side of the cab seat 37. Besides, the operation devices 35 and 36 are disposed on the front side of the cab seat 37.

The operation device 32 for the boom and the bucket includes a cross operation type operation lever, and pilot valves 32*a* to 32*d* that operate in accordance with an operation of the operation lever. The pilot valve 32*a* operates in accordance with a rear-side operation of the operation lever, generates a boom-raising pilot pressure a based on the delivery pressure of the pilot pump P4, and outputs the boom-raising pilot pressure a to a one-side pressure receiving part of the boom control valve 28. By this, the boom control valve 28 is changed over, and the hydraulic fluid from the hydraulic pump P1 is supplied to a bottom-side hydraulic chamber of the boom cylinder 18, thereby to extend the boom cylinder 18. As a result, the boom 9 is raised.

The pilot valve 32*b* operates in accordance with a front-side operation of the operation lever, generates a boom-lowering pilot pressure b based on the delivery pressure of the pilot pump P4, and outputs the boom-lowering pilot pressure b to an other-side pressure receiving part of the boom control valve 28. By this, the boom control valve 28 is changed over, and the hydraulic fluid from the hydraulic pump P1 is supplied to a rod-side hydraulic chamber of the boom cylinder 18, thereby to contract the boom cylinder 18. As a result, the boom 9 is lowered.

The pilot valve 32*c* operates in accordance with a left-side operation of the operation lever, generates a bucket-crowding pilot pressure c based on the delivery pressure of the pilot pump P4, and outputs the bucket-crowding pilot pressure c to a one-side pressure receiving part of the bucket control valve 29. By this, the bucket control valve 29 is changed over, and the hydraulic fluid from the hydraulic pump P1 is supplied to a bottom-side hydraulic chamber of the bucket cylinder 19, thereby to extend the bucket cylinder 19. As a result, the bucket 11 is crowded.

The pilot valve 32*d* operates in accordance with a right-side operation of the operation lever, generates a bucket-damping pilot pressure d based on the delivery pressure of the pilot pump P4, and outputs the bucket-damping pilot pressure d to an other-side pressure receiving part of the bucket control valve 29. By this, the bucket control valve 29 is changed over, and the hydraulic fluid from the hydraulic pump P1 is supplied to a rod-side hydraulic chamber of the bucket cylinder 19, to contract the bucket cylinder 19. As a result, the bucket 11 is damped.

The operation device 33 for the arm and for swinging includes a cross operation type operation lever, and pilot valves 33*a* to 33*d* that operate in accordance with an operation of the operation lever. The pilot valve 33*a* operates in accordance with a rear-side operation of the operation lever, generates an arm-pulling pilot pressure e based on the pressure of the pilot pump P4, and outputs the arm-pulling pilot pressure e to a one-side pressure receiving part of the arm control valve 26. By this, the arm control valve 26 is changed over, and the hydraulic fluid from the hydraulic pump P2 is supplied to a bottom-side hydraulic chamber of the arm cylinder 16, thereby extend the arm cylinder 16. As a result, the arm 10 is pulled in.

The pilot valve 33*b* operates in accordance with a front-side operation of the operation lever, generates an arm-pushing pilot pressure f based on the pressure of the pilot pump P4, and outputs the arm-pushing pilot pressure f to an other-side pressure receiving part of the arm control valve 26. By this, the arm control valve 26 is changed over, and the hydraulic fluid from the hydraulic pump P2 is supplied to a rod-side hydraulic chamber of the arm cylinder 16, thereby contract the arm cylinder 16. As a result, the arm 10 is pushed in.

The pilot valve 33*c* operates in accordance with a left-side operation of the operation lever, generates a left swing pilot pressure g based on the pressure of the pilot pump P4, and outputs the left swing pilot pressure g to a one-side pressure receiving part of the swing control valve 23. By this, the swing control valve 23 is changed over, and the hydraulic fluid from the hydraulic pump P3 is supplied to a one-side port of the swing motor 13, thereby to rotate the swing motor 13 in one direction. As a result, the upper swing structure 2 is swung to the left.

The pilot valve 33*d* operates in accordance with a right-side operation of the operation lever, generates a right swing pilot pressure h based on the pressure of the pilot pump P4, and outputs the right swing pilot pressure h to an other-side pressure receiving part of the swing control valve 23. By this, the swing control valve 23 is changed over, and the hydraulic fluid from the hydraulic pump P3 is supplied to an other-side port of the swing motor 13, thereby to rotate the swing motor 13 in the other direction. As a result, the upper swing structure 2 is swung to the right.

The operation device 35 for traveling includes a left operation member (specifically, a united body of an operation lever and an operation pedal) that can be operated in the front-rear direction, pilot valves 35*a* and 35*b* that operate in accordance with an operation of the left operation member, a right operation member (specifically, a united body of an operation lever and an operation pedal) that can be operated in the front-rear direction, and pilot valves 35*c* and 35*d* that operate in accordance with an operation of the right operation member. The pilot valve 35*a* operates in accordance with a front-side operation of the left operation member, generates a left track pilot pressure i based on the delivery pressure of the pilot pump P4, and outputs the left track pilot pressure i to a one-side pressure receiving part of the left traveling control valve 25. By this, the left traveling control valve 25 is changed over, and the hydraulic fluid from the hydraulic pump P2 is supplied to a one-side port of the left track motor 15, thereby to rotate the left track motor 15 in one direction. As a result, the left track device 4 is driven in a one-side traveling direction (normally, a forward traveling direction).

The pilot valve 35*b* operates in accordance with a rear-side operation of the left operation member, generates a left track pilot pressure j based on the delivery pressure of the pilot pump P4, and outputs the left track pilot pressure j to an other-side pressure receiving part of the left traveling control valve 25. By this, the left traveling control valve 25 is changed over, and the hydraulic fluid from the hydraulic pump P2 is supplied to an opposite-side port of the left track motor 15, thereby to rotate the left track motor 15 in the opposite direction. As a result, the left track device 4 is driven in an opposite-side traveling direction (normally, a backward traveling direction).

The pilot valve 35*c* operates in accordance with a front-side operation of the right operation member, generates a right track pilot pressure k based on the delivery pressure of the pilot pump P4, and outputs the right track pilot pressure k to a one-side pressure receiving part of the right traveling control valve 27. By this, the right traveling control valve 27 is changed over, and the hydraulic fluid from the hydraulic pump P1 is supplied to a one-side port of the right track motor 17, thereby to rotate the right track motor 17 in one direction. As a result, the right track device 5 is riven in a one-side traveling direction (normally, a forward traveling direction).

The pilot valve 35*d* operates in accordance with a rear-side operation of the right operation member, generates a right track pilot pressure 1 based on the delivery pressure of the pilot pump P4, and outputs the right track pilot pressure 1 to an other-side pressure receiving part of the right traveling control valve 27. By this, the right traveling control valve 27 is changed over, and the hydraulic fluid from the hydraulic pump P1 is supplied to an opposite-side port of the right track motor 17, thereby to rotate the right track motor 17 in the opposite direction. As a result, the right track device 5 is driven in an opposite-side traveling direction (normally, a backward traveling direction).

The operation device 36 for boom swing includes an operation pedal that can be operated in the left-right direction, and pilot valves 36*a* and 36*b* that operate in accordance with an operation of the operation pedal. The pilot valve 36*a* operates in accordance with a left-side operation of the operation pedal, generates a boom left swing pilot pressure m based on the delivery pressure of the pilot pump P4, and outputs the boom left swing pilot pressure m to a one-side pressure receiving part of the boom swing control valve 24. By this, the boom swing control valve 24 is changed over, and the hydraulic fluid from the hydraulic pump P3 is supplied to a bottom-side hydraulic chamber of the swing cylinder 14, thereby to extend the swing cylinder 14. As a result, the boom 9 is swung to the left together with the swing post 8.

The pilot valve 36*b* operates in accordance with a right-side operation of the operation pedal, generates a boom right swing pilot pressure n based on the delivery pressure of the pilot pump P4, and outputs the boom right swing pilot pressure n to an other-side pressure receiving part of the boom swing control valve 24. By this, the boom swing control valve 24 is changed over, and the hydraulic fluid from the hydraulic pump P3 is supplied to a rod-side hydraulic chamber of the swing cylinder 14, thereby to contract the swing cylinder 14. As a result, the boom 9 is swung to the right together with the swing post 8.

The operation device 34 for the blade includes an operation lever that can be operated in the front-rear direction, and pilot valves 34*a* and 34*b* that operate in accordance with an operation of the operation lever. The pilot valve 34*a* operates in accordance with a rear-side operation of the operation lever, generates a blade raising pilot pressure p based on the pressure of the pilot pump P4, and outputs the blade raising pilot pressure p to a one-side pressure receiving part of the blade control valve 22 through a pilot hydraulic line 38*a*. By this, the blade control valve 22 is changed over from a neutral position I to a raising position II (change-over position), and the hydraulic fluid from the hydraulic pump P3 is supplied to a rod-side hydraulic chamber of the blade cylinder 12, thereby to contract the blade cylinder 12. As a result, the blade 6 is raised.

The pilot valve 34*b* operates in accordance with a front-side operation of the operation lever, generates a blade lowering pilot pressure o based on the pressure of the pilot pump P4, and outputs the blade lowering pilot pressure o to an other-side pressure receiving part of the blade control valve 22 through a pilot hydraulic line 38*b*. By this, the blade control valve 22 is changed over from a neutral position I to a lowering position III (change-over position), and the hydraulic fluid from the hydraulic pump P3 is supplied to a bottom-side hydraulic chamber of the blade cylinder 12, thereby to extend the blade cylinder 12. As a result, the blade 6 is lowered.

Note that in the case where the operation lever of the operation device 32 is not operated and the right operation member of the operation device 35 is not operated, the control valves 27, 28 and 29 are situated in neutral positions, and, therefore, the hydraulic fluid delivered from the hydraulic pump P1 is returned to a tank T through the control valves 27, 28 and 29. In the case where the left operation member of the operation device 35 is not operated and the operation lever of the operation device 33 is not operated in the front-rear direction, the control valves 25 and 26 are situated in neutral positions, and, therefore, the hydraulic fluid delivered from the hydraulic pump P2 is returned to the tank T through the control valves 25 and 26. In the case where the operation lever of the operation device 34 is not operated, the operation lever of the operation device 33 is not operated in the left-right direction, and the operation pedal of the operation device 36 is not operated, the control valves 22, 23 and 24 are situated in neutral positions, and, therefore, the hydraulic fluid delivered from the hydraulic pump P3 is returned to the tank T through the control valves 22, 23 and 24.

Here, the driving device in the present embodiment is configured to be able to put the blade 6 into a float state. Specifically, the driving device includes: a branch hydraulic line 39*a* branched from a supply/discharge hydraulic line connected between the blade control valve 22 and the bottom-side hydraulic chamber of the blade cylinder 12; a branch hydraulic line 39*b* branched from a supply/discharge hydraulic line connected between the blade control valve 22 and the rod-side hydraulic chamber of the blade cylinder 12; a float valve (solenoid valve) provided between the branch hydraulic lines 39*a* and 39*b* and a tank-side hydraulic line 40; and a controller 42 that controls the float valve 41. The controller 42 includes an arithmetic control section (for example, CPU) that performs arithmetic and control processes based on a program, and a storage section (for example, ROM and/or RAM) that stores the program and the results of the arithmetic processes.

The float valve 41 can be changed over to a reference position IV and a float position V. In the case where the float valve 41 is in the reference position IV, the communication between the branch hydraulic lines 39*a* and 39*b* and the tank-side hydraulic line 40 is interrupted. By this, driving of the blade cylinder 12 by changing over the blade control valve 22 is enabled. On the other hand, in the case where the float valve 41 is in the float position V, the communication between the branch hydraulic lines 39*a* and 39*b* and the tank-side hydraulic line 40 is established. In other words, the bottom-side hydraulic chamber and the rod-side hydraulic chamber of the blade cylinder 12 are made to communicate with the tank T. By this, the blade 6 is put into the float state.

Figure 3:
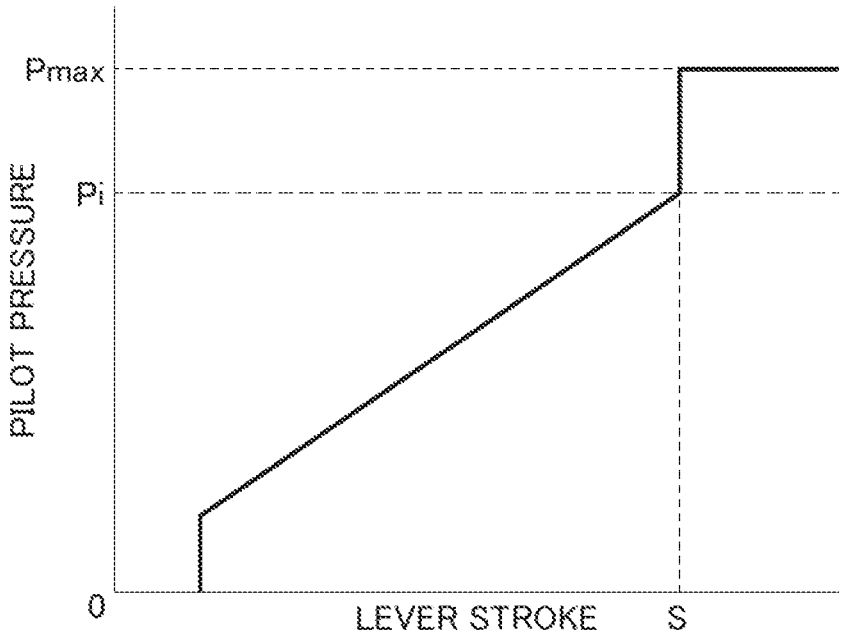
FIG. 3 is a diagram representing the relation between a lever stroke and a blade lowering pilot pressure of a blade operation device in one embodiment of the present invention.

In addition, in the present embodiment, the blade operation device 34 has incorporated therein a float instruction device that performs a float instruction for putting the blade 6 into the float state, such that the float instruction can be performed in the case where the operation lever is operated to the front side (or in the blade-lowering direction) by not less than a predetermined stroke. More specifically, the pilot valve 34*b* raises the blade lowering pilot pressure o as the lever stroke increases, as illustrated in FIG. 3. Then, when the lever stroke becomes equal to or higher than a predetermined value S (or when the operation lever reaches a detent position), the blade lowering pilot pressure o is rapidly raised to a maximum Pmax, thereby causing the blade lowering pilot pressure o to exceed a preset threshold Pi (for example, 3 MPa). The pilot hydraulic line 38*b* for blade lowering is provided therein with a pilot pressure sensor 43, and the controller 42 determines whether or not the float instruction has been performed, based on whether or not the blade lowering pilot pressure o detected by the pilot pressure sensor 43 is equal to or higher than the threshold Pi.

In addition, in the present embodiment, the pilot hydraulic line 38*b* is provided therein with a selector valve (solenoid valve), and the controller 42 controls the selector valve 44 in cooperation with the float valve 41. The selector valve 44 can be changed over to a communication position VI and an interruption position VII. In the case where the selector valve 44 is in the communication position VI, a blade lowering pilot pressure o can be outputted from the blade operation device 34 to the other-side pressure receiving part of the blade control valve 22, and an operation of the blade control valve 22 by the blade operation device 34 is valid. On the other hand, in the case where the selector valve 44 is in the interruption position VII, the blade lowering pilot pressure o cannot be outputted from the blade operation device 34 to the other-side pressure receiving part of the blade control valve 22, and the operation of the blade control vale 22 by the blade operation device 34 is invalid.

Besides, in the present embodiment, a pressure sensor 45 is provided for detecting the pressure in the bottom-side hydraulic chamber of the blade cylinder 12, and the controller 42 determines whether or not the blade 6 is in the state of jacking up the machine body, based on the results of detection by the pilot pressure sensor 43.

The contents of processing by the controller 42 in the present embodiment will be described below. FIG. 3 is a flow chart representing a processing procedure of the controller in the present embodiment.

First, in step S101, the controller 42 determines whether or not the blade 6 is in the state of jacking up the machine body, based on the results of detection by the pressure sensor 45. Specifically, whether or not the blade 6 is in the state of jacking up the machine body is determined based on whether or not the pressure in the bottom-side hydraulic chamber of the blade cylinder 12 is equal to or higher than a preset reference value (for example, 10 MPa) and such a state has continued for a predetermined time (for example, several minutes).

For example, in the case where the pressure in the bottom-side hydraulic chamber of the blade cylinder 12 is equal to or higher than the reference value and such a state has continued for the predetermined time, the controller 42 determines that the blade 6 is in the state of jacking up the machine body. In this instance, determination in step S101 is YES, and the control proceeds to step S102. In step S102, the controller 42 turns OFF a control signal for the float valve 41, to thereby hold the float valve 41 in the reference position IV, irrespectively of the presence or absence of a float instruction. In addition, the controller 42 turns OFF a control signal for the selector valve 44, to thereby hold the selector valve 44 in the communication position VI, irrespectively of the presence or absence of the float instruction. Thereafter, the control returns to step S101, and the aforementioned processing is conducted.

For example, in the case where the pressure in the bottom-side hydraulic chamber of the blade cylinder 12 is less than the reference value or where the pressure in the bottom-side hydraulic chamber of the blade cylinder 12 is equal to or higher than the reference value but such a state has not continued for the predetermined time, the controller 42 determines that the blade 6 is not in the state of jacking up the machine body. In this instance, the determination in step S101 is NO, and the control proceeds to step S103. In step S103, the controller 42 determines whether or not a float instruction has been performed, based on whether or not the blade lowering pilot pressure o detected by the pilot pressure sensor 43 is equal to or higher than the threshold Pi.

For example, in the case where the blade lowering pilot pressure o is less than the threshold Pi, the controller 42 determines that the float instruction has not been performed. In this instance, the determination in step S103 is NO, the control proceeds to step S102, and the aforementioned processing is executed. On the other hand, for example, in the case where the blade lowering pilot pressure o is equal to or higher than the threshold Pi, the controller 42 determines that the float instruction has been performed. In this instance, the determination in step S103 is YES, and the control proceeds to step S104. In step S104, the controller 42 turns ON the control signal for the float valve 41, to thereby change over the float valve 41 to the float position V. In addition, the controller 42 turns ON the control signal for the selector valve 44, to thereby change over the selector valve 44 to the interruption position VII.

Thereafter, the control returns not to step S101 but to step S102, and the aforementioned processing is performed. Specifically, when the blade 6 is in the float state (when the float valve 41 is in the float position V and the selector valve 44 is in the interruption position VII), the controller 42 does not determined whether or not the blade 6 is in the state of jacking up the machine body. This is because the pressure in the bottom-side hydraulic chamber of the blade cylinder 12 may exceed a reference value in the case where a leveling operation is being performed by the blade 6 in the float state.

An operation and effects of the present embodiment will be described below. The blade 6 of the hydraulic excavator is used, for example, in the case of jacking up the machine body for maintenance or cleaning of an undercarriage of the machine body or in the case of performing a leveling work.

(1) Jack-Up of Machine Body

Figure 4:
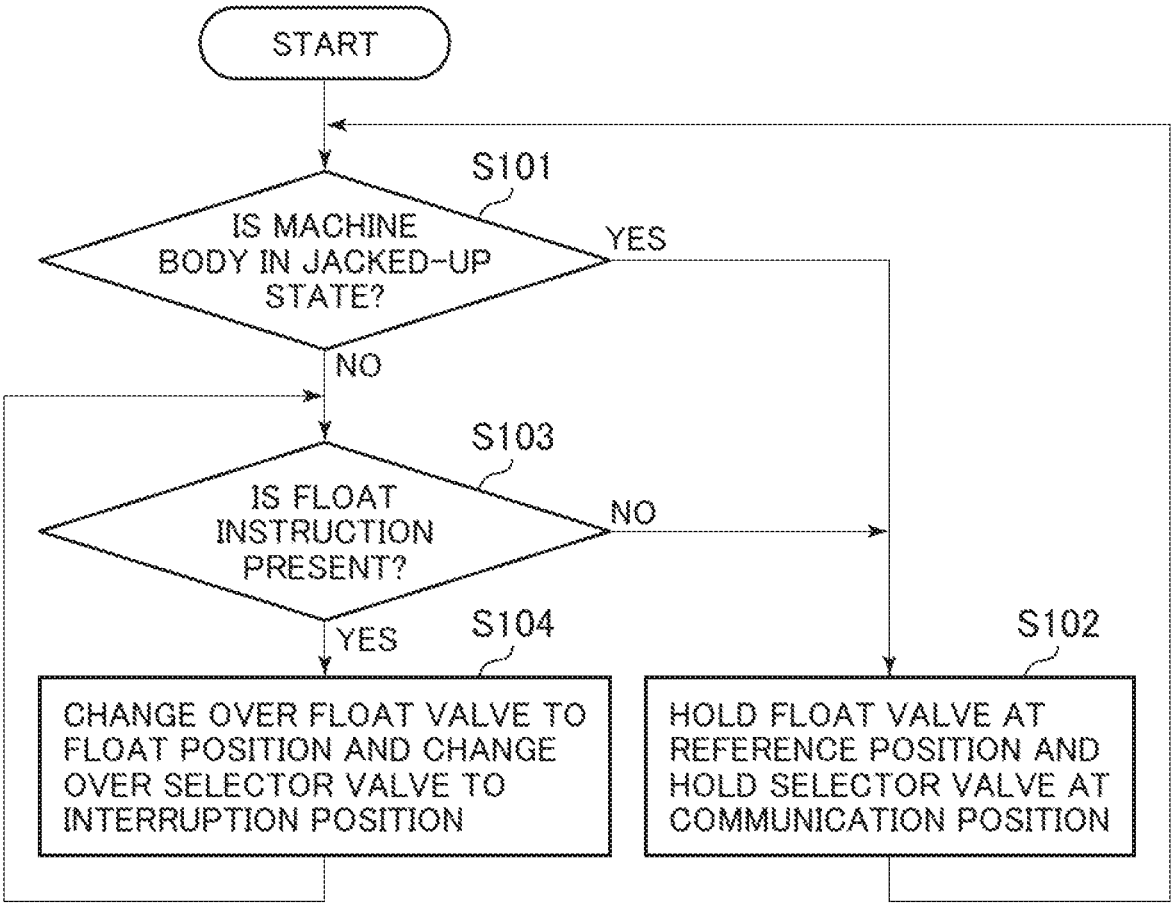
FIG. 4 is a flow chart representing a processing procedure of a controller in one embodiment of the present invention.

An operation in the case of jacking up the machine body of the hydraulic excavator as depicted in FIG. 4 will be described. First, when the hydraulic excavator is in the state as illustrated in FIG. 1, an operator operates the operation device 33 to reverse the upper swing structure 2 by 180 degrees. Then, the operator operates the operation devices 32 and 33 to change the posture of the work device 7 and to bring the bucket 11 into contact with the ground. Then, the operator operates the operation device 32 to lower the boom 9, thereby lifting up a rear portion of the lower track structure 1 from the ground. In addition, the operator operates the operation device 34 (operates the operation device 34 such that the operation lever does not reach a detent position) to lower the blade 6, thereby lifting up a front portion of the lower track structure 1 from the ground. By this, the machine body is put into a jacked-up state.

In a state in which the blade 6 is jacking up the machine body, the pressure in the bottom-side hydraulic chamber of the blade cylinder 12 is equal to or higher than a reference value. When the state in which the pressure in the bottom-side hydraulic chamber of the blade cylinder 12 is equal to or higher than the reference value continues for a predetermined time, the controller 42 determines that the blade 6 is in the state of jacking up the machine body. In this case, even if the operator performs a float instruction by the blade operation device 34 by mistake, the controller 42 proceeds to step S102 through step S101 in the aforementioned FIG. 4, to hold the float valve 41 in the reference position IV and hold the selector valve 44 in the communication position VI. In the reference position IV of the float valve 41, the blade cylinder 12 can be driven, and the blade 6 is not put into the float state.

(2) Leveling Work

An operation in the case of putting the blade 6 into the float state and performing a leveling work will be described. When the blade 6 is not in the state of jacking up the machine body, the pressure in the bottom-side hydraulic chamber of the blade cylinder 12 is less than the reference value. As a result, the controller 42 determines that the blade 6 is not in the state of jacking up the machine body. In this case, when the operator performs a float instruction by the blade operation device 34, the controller 42 proceeds to S104 through steps S101 and S103 in the aforementioned FIG. 4, to change over the float valve 41 into the float state V and change over the selector valve 44 into the interruption position VII.

In the float position V of the float valve 41, the bottom-side hydraulic chamber and the rod-side hydraulic chamber of the blade cylinder 12 communicate with the tank T. As a result, the blade 6 is put into the float state. In this instance, the blade 6 is lowered by its own weight, to make contact with the ground. Then, when the operator operates the operation device 35 to cause the hydraulic excavator to travel forward or backward, the blade 6 being in the float state ensures that even if the ground is rugged, the hydraulic excavator can follow up to the rugged shape. Therefore, a favorable leveling work can be performed.

As aforementioned, in the present embodiment, in the case where the machine body is in a jacked-up state, the float valve 41 is maintained in the reference position IV even if the operator performs a float instruction by the blade operation device 34 by mistake. Specifically, the blade 6 is not put into the float state, and, therefore, the machine body can be prevented from being lowered. On the other hand, in the case where the machine body is not in a jacked-up state, when the operator performs a float instruction by the blade operation device 34, the float valve 41 is changed over to the float position V. Specifically, the bottom-side hydraulic chamber and the rod-side hydraulic chamber of the blade cylinder 12 are made to communicate with the tank T, whereby the blade 6 is put into the float state, and, therefore, a favorable leveling work can be performed.

In addition, in the present embodiment, in the case of putting the blade 6 in the float state (or in the case where the operator performs a float instruction by the blade operation device 34 to change over the float valve 41 to the float position V), the selector valve 44 is changed over to the interruption position VII, to thereby invalidate the operation of the blade control valve 22 by the blade operation device 34. In other words, the blade control valve 22 is held in the neutral position I. As a result, for example, unlike in the case where the blade control valve 22 is changed over to the lowering position III by the blade operation device 34, the hydraulic fluid from the hydraulic pump P3 is not returned to the tank T through the blade control valve 22 and the float valve 41, but is supplied to other control valves (in the present embodiment, the swing control valve 23 and the boom swing control valve 24). Therefore, even in the case of putting the blade 6 into the float state, the hydraulic fluid can be supplied to other actuators (in the present embodiment, the swing motor 13 and the swing cylinder 14) through the aforementioned other control valves, so that the other actuators can be driven.

Besides, in the present embodiment, in the case of remodeling an existing hydraulic excavator such that the blade 6 can be put into a float state, it is unnecessary to modify the valve unit 21, and it is only necessary to add the float valve 41, the controller 42, the pilot pressure sensor 43, the selector valve 44 and the pressure sensor 45. Therefore, the existing hydraulic excavator can be remodeled easily.

Note that the case where the float valve 41 is provided in the branch hydraulic lines 39*a* and 39*b* communicating respectively with the bottom-side hydraulic chamber and the rod-side hydraulic chamber of the blade cylinder 12 has been taken as an example in the description of the above embodiment, this is not limitative, and modifications are possible within the scope of the gist and technical thought of the present invention. Specifically, a float valve may be provided such as to be interposed in both a supply/discharge hydraulic line connected between the bottom-side hydraulic chamber of the blade cylinder 12 and the blade control valve 22 and a supply/discharge hydraulic line connected between the rod-side hydraulic chamber of the blade cylinder 12 and the blade control valve 22. Besides, in the case where the float valve is in a reference position, the bottom-side hydraulic chamber and the rod-side hydraulic chamber of the blade cylinder 12 are made to communicate with the blade control valve 22. On the other hand, in the case where the float valve is in a float position, the bottom-side hydraulic chamber and the rod-side hydraulic chamber of the blade cylinder 12 are made to communicate with the tank. In such a modification, also, an effect similar to that in the above embodiment can be obtained.

In addition, the case where the pressure sensor 45 for detecting the pressure in the bottom-side hydraulic chamber of the blade cylinder 12 is provided and where whether or not the blade 6 is in the state of jacking up the machine body is determined by the controller 42 based on whether or not the pressure detected by the pressure sensor 45 is equal to or higher than a preset reference value and such a state has continued for a predetermined time has been taken as an example in the description of the above embodiment, this is not restrictive. Modifications are possible within the scope of the gist and technical thought of the present invention. For example, a pressure sensor for detecting the pressure in the rod-side hydraulic chamber of the blade cylinder 12 may be provided, and whether or not the blade 6 is in the state of jacking up the machine body may be determined based on whether or not the pressure detected by the pressure sensor is equal to or lower than a preset reference value and such a state has continued for a predetermined time. Alternatively, for example, a first pressure sensor for detecting the pressure in the bottom-side hydraulic chamber of the blade cylinder 12 and a second pressure sensor for detecting the pressure in the rod-side hydraulic chamber of the blade cylinder 12 may be provided, and whether or not the blade 6 is in the state of jacking up the machine body may be determined based on whether or not the pressure detected by the first pressure sensor is equal to or higher than a present first reference value and the pressure detected by the second pressure sensor is equal to or lower than a present second reference value (provided that (second reference value)<(first reference value)). In these modifications, also, an effect similar to that in the above embodiment can be obtained.

Figure 6:
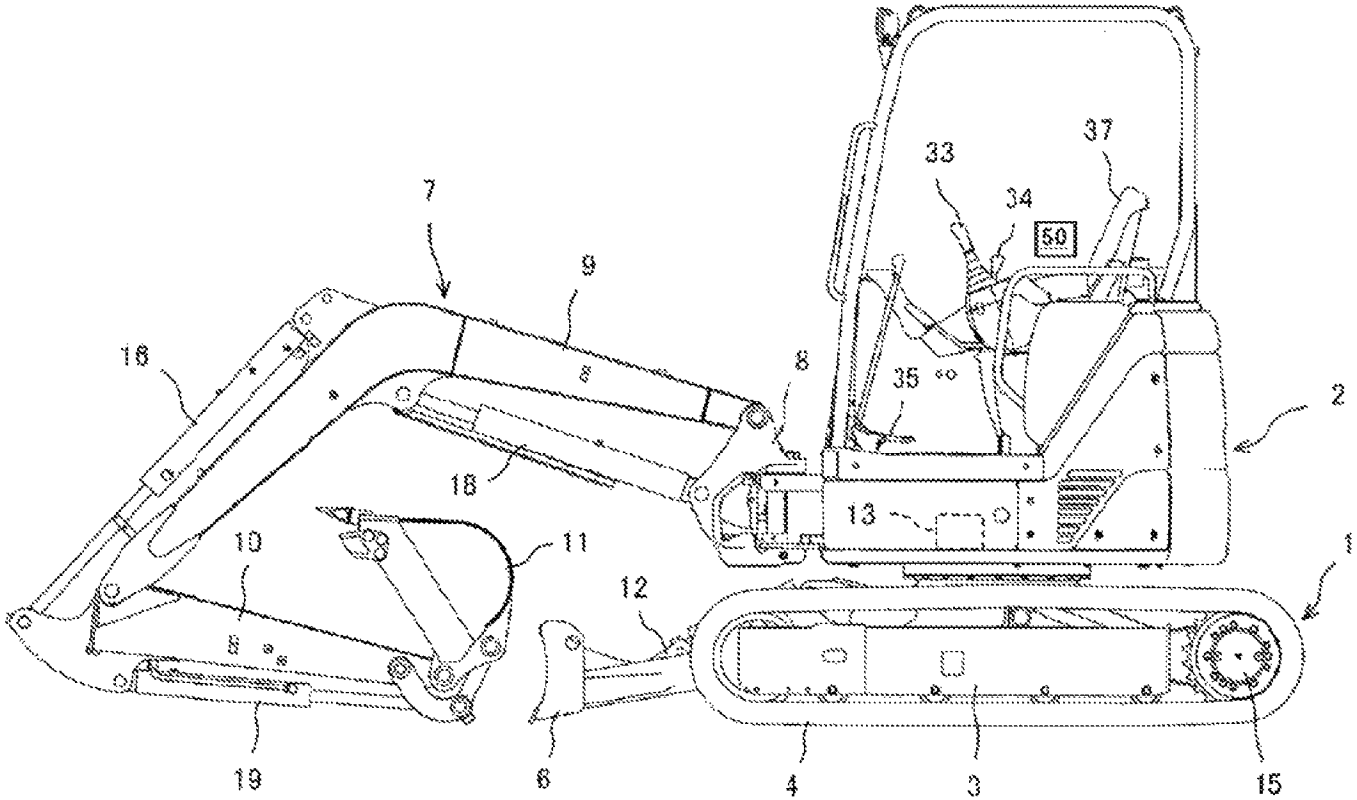
FIG. 6 is a side view representing the structure of a hydraulic excavator in one embodiment of the present invention.

Besides, the case where the blade operation device 34 has the float instruction device incorporated therein and the selector valve 44 is provided in only the pilot hydraulic line 38*b* has been taken as an example in the description of the above embodiment, this is not limitative. Modifications are possible within the scope of the gist and technical thought of the present invention. Specifically, a float instruction device (specifically, for example, a float switch) 50 may be provided as a separate body from the blade operation device 34, as shown in FIG. 6, and two selector valves may be provided in the pilot hydraulic lines 38*a* and 38*b*, respectively. In the case where it is determined that the blade 6 is not in the state of jacking up the machine body, the controller changes over the float valve 41 to the float position, and changes over the two selector valves to the interruption positions to invalidate an operation of the blade control valve 22, in accordance with the float instruction. In the case where it is determined that the blade 6 is in the state of jacking up the machine body, the controller holds the float valve 41 in the reference position, and holds the two selector valves in the communication positions to validate the operation of the blade control valve 22, irrespectively of the presence or absence of the float instruction. In such a modification, also, an effect similar to that in the above embodiment can be obtained.

In addition, the configuration in which the blade operation device 34 generates a pilot pressure in accordance with the stroke of the operation lever and outputs the pilot pressure to the blade control valve 22 has been taken as an example in the description of the above embodiment, this is not restrictive. Modifications are possible within the scope of the gist and technical thought of the present invention. Specifically, a configuration may be adopted in which the blade operation device 34 detects the stroke of the operation lever and outputs the stroke to the controller, the controller generates a control signal in accordance with the stroke of the operation lever and outputs the control signal to a solenoid proportional pressure reducing valve, and the solenoid proportional pressure reducing valve generates a pilot pressure in accordance with the control signal and outputs the pilot pressure to the blade control valve. Besides, in place of the selector valve 44 in the above embodiment, the controller may perform a processing for validating or invalidating a control signal, thereby to validate or invalidate the operation of the blade control valve 22. In such a modification, also, an effect similar to that in the above embodiment can be obtained.

Besides, the configuration (open center system) wherein the control valves 22 to 29 are of the open center type and the hydraulic fluid from the hydraulic pumps P1, P2 and P3 is returned to the tank when the control valves are in the neutral positions has been taken as an example in the above embodiment, this is not restrictive. Modifications are possible within the scope of the gist and technical thought of the present invention. Specifically, a configuration (a closed center system provided with a load sensing control function) may be adopted in which the control valves are of a closed center type and the hydraulic fluid from the hydraulic pumps is returned to the tank through an unloading valve when the control valves are in the neutral positions.

In addition, the case where the three hydraulic pumps P1, P2 and P3 are provided as main pumps has been taken as an example in the description of the above embodiment, this is not limitative. Modifications are possible within the scope of the gist and technical thought of the present invention. Specifically, it is sufficient that at least one hydraulic pump is provided.

Note that the case where the present invention is applied to a hydraulic excavator has been taken as an example in the above description, this is not restrictive. The present invention may be applied to other construction machines (specifically, for example, a wheel loader).

DESCRIPTION OF REFERENCE CHARACTERS

1: Lower track structure
2: Upper swing structure
6: Blade
12: Blade cylinder
22: Blade control valve
34: Blade operation device
34*a*, 34*b*: Pilot valve
38*a*, 38*b*: Pilot hydraulic line
39*a*, 39*b*: Branch hydraulic line
40: Tank-side hydraulic line
41: Float valve
42: Controller
43: Pilot pressure sensor
44: Selector valve
45: Pressure sensor
50: Float instruction device
P1, P2, P3: Hydraulic pump
T: Tank

The invention claimed is:

1. A construction machine comprising:

a blade provided to be drivable in a vertical direction relative to a machine body;

a blade cylinder that is operated by a hydraulic fluid delivered from a hydraulic pump and that drives the blade in the vertical direction;

a blade control valve that controls a flow of the hydraulic fluid from the hydraulic pump to the blade cylinder;

a blade operation device that operates the blade control valve;

a float instruction device that performs a float instruction for putting the blade into a float state;

a float valve that is provided in hydraulic lines communicating respectively with a bottom-side hydraulic chamber and a rod-side hydraulic chamber of the blade cylinder, and that has a reference position where driving of the blade cylinder is possible and a float position where the bottom-side hydraulic chamber and the rod-side hydraulic chamber of the blade cylinder communicate with a tank to put the blade into the float state;

a pressure sensor that detects a pressure in at least one of the bottom-side hydraulic chamber and the rod-side hydraulic chamber of the blade cylinder; and a controller configured to determine whether or not the blade is in a state of jacking up the machine body and control the float valve, based on results of detection by the pressure sensor, wherein the controller is configured to:

change over the float valve to the float position and invalidate an operation of the blade control valve by the blade operation device, in accordance with the float instruction, in a case where it is determined that the blade is not in the state of jacking up the machine body; and hold the float valve in the reference position and validate the operation of the blade control valve by the blade operation device, irrespectively of the presence or absence of the float instruction, in a case where it is determined that the blade is in the state of jacking up the machine body.

2. The construction machine according to claim 1, wherein the blade operation device is configured to generate a pilot pressure in accordance with an operation of an operation lever and to output the pilot pressure to the blade control valve through a pilot hydraulic line, thereby operating the blade control valve, a selector valve having an interruption position and a communication position is provided in the pilot hydraulic line, and the controller is configured to:

change over the float valve to the float position and change over the selector valve to the interruption position to invalidate the operation of the blade control valve, in accordance with the float instruction, in the case where it is determined that the blade is not in the state of jacking up the machine body, and hold the float valve in the reference position and hold the selector valve in the communication position to validate the operation of the blade control valve, irrespectively of the presence or absence of the float instruction, in the case where it is determined that the blade is in the state of jacking up the machine body.

3. The construction machine according to claim 1, wherein the blade operation device includes:

a first pilot valve that generates a blade raising pilot pressure in accordance with an operation on one side of an operation lever, and outputs the blade raising pilot pressure to the blade control valve through a first pilot hydraulic line to operate the blade control valve; and a second pilot valve that generates a blade lowering pilot pressure in accordance with an operation on the other side of the operation lever, and outputs the blade lowering pilot pressure to the blade control valve through a second pilot hydraulic line to operate the blade control valve, the float instruction device is incorporated in the blade operation device, and is able to perform the float instruction in a case where the operation lever is operated to the opposite side by not less than a predetermined stroke, and the controller is configured to determine that the float instruction has been performed when a blade lowering pilot pressure detected by a pilot pressure sensor provided in the second pilot hydraulic line is equal to or higher than a preset threshold.

4. The construction machine according to claim 3, wherein a selector valve having an interruption position and a communication position is provided in the second pilot hydraulic line, and the controller is configured to:

change over the float valve to the float position and change over the selector valve to the interruption position to invalidate the operation of the blade control valve, in accordance with the float instruction, in the case where it is determined that the blade is not in the state of jacking up the machine body, and hold the float valve in the reference position and hold the selector valve in the communication position to validate the operation of the blade control valve, irrespectively of the presence or absence of the float instruction, in the case where it is determined that the blade is in the state of jacking up the machine body.

* * * * *